US010052685B2

(12) United States Patent
Schaechtl et al.

(10) Patent No.: US 10,052,685 B2
(45) Date of Patent: Aug. 21, 2018

(54) PROCESSING SYSTEM FOR PROCESSING A CAST RAW CASTING AND METHOD FOR PRODUCING A CAST COMPONENT

(71) Applicant: Bayerische Motoren Werke Aktiengesellschaft, Munich (DE)

(72) Inventors: Richard Schaechtl, Pfeffenhausen (DE); Andreas Fent, Straubing (DE); Hubert Moreis, Walkertshofen (DE); Lucas Schulte-Vorwick, Landshut (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 15/277,085

(22) Filed: Sep. 27, 2016

(65) Prior Publication Data

US 2017/0014899 A1 Jan. 19, 2017

Related U.S. Application Data

(63) Continuation of application No. PCT/EP2015/054998, filed on Mar. 11, 2015.

(30) Foreign Application Priority Data

Mar. 31, 2014 (DE) ..... 10 2014 205 999

(51) Int. Cl.
*B22D 11/22* (2006.01)
*B22D 30/00* (2006.01)
(Continued)

(52) U.S. Cl.
CPC ..... *B22D 11/22* (2013.01); *B22D 11/14* (2013.01); *B22D 30/00* (2013.01); *B22D 31/00* (2013.01)

(58) Field of Classification Search
CPC ..... B22D 11/22; B22D 11/14; B22D 30/00; B22D 31/00
See application file for complete search history.

(56) References Cited

U.S. PATENT DOCUMENTS 4,592,407 A 6/1986 Yamaguchi et al.
6,557,622 B2 5/2003 Frank et al.
(Continued)

FOREIGN PATENT DOCUMENTS

CN 1652886 A 8/2005
CN 103357847 A 10/2013
(Continued)

OTHER PUBLICATIONS

International Search Report (PCT/ISA/210) issued in PCT Application No. PCT/EP2015/054998 dated Jun. 1, 2015, with English translation (four (4) pages).
(Continued)

*Primary Examiner* — Kevin P Kerns
*Assistant Examiner* — Steven S Ha
(74) *Attorney, Agent, or Firm* — Crowell & Moring LLP

(57) ABSTRACT

A processing system and method for processing a cast raw casting has a spray system for cooling the raw casting. The spray system has at least one nozzle device for at least temporally, locally, or quantitatively variable application of a free-flowing medium to at least one section of the raw casting. The processing system also has a temperature measuring device for measuring the temperature on at least one section of the raw casting and a monitoring device for controlling and adjusting the nozzle device as a function of the measured temperature.

17 Claims, 3 Drawing Sheets

(51) Int. Cl.
*B22D 31/00* (2006.01)
*B22D 11/14* (2006.01)

(56) References Cited

U.S. PATENT DOCUMENTS

| | | | | |
|---|---|---|---|---|
| 6,672,367 | B2 | 1/2004 | Crafton et al. | |
| 2002/0129921 | A1 | 9/2002 | Frank et al. | |
| 2010/0032128 | A1* | 2/2010 | Schlichting ..... | B22D 11/0622 164/463 |
| 2014/0116576 | A1 | 5/2014 | Guthrie et al. | |

FOREIGN PATENT DOCUMENTS

| | | | |
|---|---|---|---|
| DE | 33 16 951 | C2 | 2/1989 |
| DE | 200 10 074 | U1 | 10/2000 |
| DE | 10 2007 027 220 | A1 | 1/2009 |
| DE | 20 2009 018 183 | U1 | 7/2011 |
| DE | 10 2011 119 002 | A1 | 5/2013 |
| DE | 10 2013 221 357 | A1 | 4/2014 |
| EP | 2 527 060 | A1 | 11/2012 |
| JP | 2009-255118 | A | 11/2009 |
| WO | WO 03/086683 | A1 | 10/2003 |
| WO | WO 2012/028954 | A1 | 3/2012 |

OTHER PUBLICATIONS

German Search Report issued in counterpart German Application No. 10 2014 205 999.2 dated Dec. 18, 2014, with partial English translation (eleven (11) pages).

Chinese-language Office Action issued in counterpart Chinese Application No. 201580003545.0 dated Mar. 29, 2017 with English translation (fourteen (14) pages).

* cited by examiner

PROCESSING SYSTEM FOR PROCESSING A CAST RAW CASTING AND METHOD FOR PRODUCING A CAST COMPONENT

CROSS REFERENCE TO RELATED APPLICATIONS

This application is a continuation of PCT International Application No. PCT/EP2015/054998, filed Mar. 11, 2015, which claims priority under 35 U.S.C. § 119 from German Patent Application No. 10 2014 205 999.2, filed Mar. 31, 2014, the entire disclosures of which are herein expressly incorporated by reference.

BACKGROUND AND SUMMARY OF THE INVENTION

The present invention relates to a processing apparatus for the processing of a cast raw casting, and to a casting cell for the production of a cast component, which casting cell has a casting machine and a processing apparatus. The present invention also relates to a method for the production of a cast component.

It is basically known that, in the die casting process, which is an industrial casting process for the production of mass-produced components, use is generally made of metallic materials with a low melting point. Here, it is the case in particular that liquid melt is forced at a high pressure of approximately 10 MPa to 120 MPa, and at a relatively high mold filling speed of for example up to 120 m/s, into a die casting mold, which can also be referred to as cavity, in which the melt solidifies to form a raw casting. The die casting process is advantageously performed using a permanent mold and consequently without a correspondingly required model, such that here, a low level of production outlay is involved in the manufacture of mass-produced components. The structural components produced for example in the die casting process, which structural components are advantageously magnesium and aluminum structural components, are, in a known manner, removed from the casting machine in the hot state and subsequently subjected to coarse deburring in a press within the casting cell. The fine deburring is, however, performed at a much later point in time when the raw casting that has been removed from the casting machine has cooled to room temperature (generally 25° C.). This means that the second deburring process, specifically the fine deburring process, must be performed using a further additional punching tool in an additional press, which may be arranged outside the casting cell. Furthermore, it is basically known that the raw castings normally have to be manually straightened in the cold state, which is time-consuming and expensive, in order to possibly achieve required component tolerances.

It is therefore the object of the present invention to at least partially eliminate the above-described disadvantages in the case of a processing apparatus for the processing of a cast raw casting and a casting cell for the production of the cast component. In particular, it is the object of the present invention to provide a processing apparatus for the processing of a cast raw casting, and a casting cell for the production of the cast component, and in particular a method for the production of the cast component, by way of which it is possible to produce a cast component in a simple and inexpensive manner, wherein, in the production of the cast component, it is possible to dispense with separately successive processing steps, such as the mutually separated coarse deburring and fine deburring and the straightening process performed separately therefrom. The cast component should advantageously be produced, and in particular processed, within one casting cell.

The above object is achieved by way of a processing apparatus for the processing of a cast raw casting, and by way of a casting cell for the production of a cast component, and furthermore by way of a method for the production of a cast component, in accordance with embodiments of the invention. Here, features and details that are described in conjunction with the processing apparatus self-evidently also apply in conjunction with the casting cell according to the invention and/or the method according to the invention for the production of a cast component, and vice versa in each case, such that, with regard to the disclosure, reference is always made, or can always be made, reciprocally to the individual aspects of the invention.

The processing apparatus according to the invention for the processing of a cast raw casting has a spraying apparatus for the cooling of the raw casting, which spraying apparatus has at least one nozzle device for the at least temporally, spatially or quantitatively variable application of a flowable medium to at least one section of the raw casting, and a temperature measurement device for the measurement of the temperature at at least one section of the raw casting, and a control device for the control and regulation of the nozzle device in a manner dependent on the measured temperature. The raw casting itself is advantageously a raw part which is formed after the casting process but which must thereafter undergo further machining and, in particular, be straightened and deburred, such that, from the raw casting, a cast component can be produced, which according to the present invention is to be understood to mean a finished component which can be arranged, for example, in a component assembly. The processing apparatus itself advantageously serves for performing the subsequent processing of the raw casting cast in particular by way of a casting machine. For this purpose, the processing apparatus has a spraying apparatus which has at least one nozzle device which serves for the application of a flowable medium, which is advantageously a water-air mixture, to at least sections of the raw casting. The nozzle device of the spraying apparatus may itself be arranged for example so as to be static, that is to say immovable, or movable relative to the raw casting to be cooled. In the case of a static arrangement of the nozzle device within the spraying apparatus, it is accordingly possible for the raw casting to be moved along a processing or transport path through the spraying apparatus, along or past the nozzle device. Furthermore, it is also contemplated for the raw casting to be moved not only in a translational movement in the direction of the transport path along the nozzle device, but also in rotation about its longitudinal axis along the nozzle device, such that it is possible by way of the nozzle device for the flowable medium to be applied to any section of the raw casting. If the nozzle device itself is arranged so as to be movable relative to the raw casting to be cooled, the nozzle device can be moved along the raw casting, which is advantageously arranged so as to be static and thus immovable within the spraying apparatus, in order to permit an application of the flowable medium to any section of the raw casting. The amount of flowable medium to be applied, the mixture ratio in which it is to be applied and the time period in which it is to be applied, and the section of the raw casting to which it is to be applied, are advantageously determined on the basis of the values measured by the temperature measurement device.

The temperature measurement device, which accordingly constitutes a unit of the processing apparatus, advantageously measures the temperature of the raw casting at at least one section of the raw casting, wherein it is also contemplated for the temperature measurement device to determine the temperature of the raw casting at various sections of the raw casting.

A control device, which is connected to the temperature measurement device and advantageously to the nozzle device for data communication purposes, advantageously serves at least for the control or regulation of the nozzle device in a manner dependent on the measured temperature. Consequently, the control device can define that section of the raw casting to which flowable medium is to be applied, the amount of flowable medium to be applied, and the time duration in which it is to be applied and/or the mixture ratio in which it is to be applied.

The processing apparatus advantageously serves firstly for the cooling of the raw casting and secondly advantageously also for the straightening of the raw casting, as will be described in detail below. The raw casting is advantageously cooled by way of the processing apparatus according to the invention, owing to the precisely dosable flowable medium, to a temperature of advantageously less than 80° C. and particularly advantageously less than 50° C., such that, in the subsequent step, the coarse and fine deburring can be made possible in a single processing step, advantageously within one casting cell.

The processing apparatus according to the invention advantageously has a geometry measurement device for the measurement of at least one geometry of the raw casting. Accordingly, the geometry measurement device is advantageously a unit of the processing apparatus, and is particularly advantageously also connected, for data communication purposes, to the control device in wired or wireless fashion in order to transmit determined or measured measurement values to the control device, which thereupon determines whether a deviation of the geometry, and in particular of individual dimensions, of the raw casting exists. It is accordingly advantageously possible for the control device to actuate the at least one nozzle device, not only on the basis of the measurement values from the temperature measurement device but advantageously also on the basis of the measurement values of the geometry measurement device. This is done in such a way that the at least one nozzle device applies a defined amount of flowable medium to a defined section or region of the raw casting, advantageously in a defined mixture ratio, in defined time intervals, in order to specifically cool the raw casting and consequently, on the basis of a targeted impingement of the flowable medium on the raw casting, to targetedly counteract possible distortion.

The processing apparatus advantageously has a comparison device for the comparison of the measured temperature value with a reference temperature value and/or of the measured geometry value with a reference geometry value. Accordingly, the comparison device, which is advantageously also a unit of the processing apparatus, is particularly advantageously connected for data communication purposes to the control device, and compares the received actual values with, for example, setpoint values stored in a memory device. The memory device is preferably a unit of the control device, though it may also be an independent unit. The comparison of the values leads, for example, to a defined application of the flowable medium to defined sections of the raw casting, and thus to defined cooling and/or straightening of the raw casting or else to a stoppage of cooling and/or straightening.

In the context of the invention, it is furthermore possible for the nozzle device to have at least one two-substance nozzle for the application of two mutually different flowable substances to the raw casting. By way of the two-substance nozzle, the two flowable substances can be combined in quantitatively variable fashion to form the flowable medium. It is accordingly contemplated for the flowable medium, which is for example a water-air mixture, to be able to be varied in terms of its mixture ratio in flexible fashion. The flowable medium is advantageously applied in the form of a spray mist to the raw casting and, in particular, to at least one section of the raw casting. It is advantageously the case that, in the flowable medium, in particular in the water-air mixture, the water droplets are sprayed in finely atomized form onto the component, wherein, in the context of the invention, it is assumed that the Leidenfrost effect is less pronounced the more finely the water droplets are atomized. The Leidenfrost effect is a physical effect which involves the delayed substance conversion and, in particular, the temporally lengthened change of the state of aggregation. Based on the Leidenfrost effect, it is consequently disadvantageously possible that a desired short time for the cooling of the raw casting could be lengthened for example by a vapor layer that accumulates between the raw casting and the cooling medium. Accordingly, in the context of the invention, spray mist is emitted only in such a quantity that water can be evaporated without residue. The amount is advantageously regulated with real-time control in a manner dependent on the spray duration and/or raw casting temperature. It is advantageously possible in this way for an accumulation of water on the raw casting, and consequently an associated entrainment of water within the casting cell, to be prevented, in particular by virtue of the amount of sprayed water being continuously reduced such that, in particular, the temporally final time segment of the cooling phase is advantageously performed only with air.

It is furthermore contemplated for the spraying apparatus to have a plurality of nozzle devices which are arranged so as to be static or so as to be movable relative to the raw casting to be cooled, which nozzle devices are arranged spaced apart from one another within the spraying apparatus. Accordingly, the spraying apparatus may advantageously have two or more nozzle devices, which can advantageously be controlled or regulated independently of one another by way of the control device. It is accordingly advantageously possible for each nozzle device of the spraying apparatus to apply, in relation to another nozzle device of the spraying apparatus, a different amount of flowable medium, or else flowable medium with a different mixture ratio, to in each case mutually different sections or regions of the raw casting. In this way, defined cooling of individual sections of the raw casting can be made possible, whereby it is advantageously in turn the case that occurring distortion is counteracted in targeted fashion by way of the defined cooling, or by way of which targeted straightening is effected.

It is furthermore contemplated for the spraying apparatus to have a sprue gripper for the positioning of the raw casting relative to the nozzle device. By way of the sprue gripper, it is advantageously possible for the raw casting to be fixed within the spraying apparatus, such that the shrinkage that occurs during the cooling process can have no influence on the gripping position.

Also provided is a casting cell for the production of a cast component, having at least one casting machine with at least one cavity for the generation of a raw casting, and having at least one processing apparatus in accordance with embodiments of the invention. It is advantageously consequently the case that a casting cell for the production of a cast component is provided which has, inter alia, a processing apparatus of the type mentioned above. In the context of the invention, it is advantageously possible for the raw casting to be generated, cooled and processed within the casting cell, such that transport paths between the casting region and the processing region are accordingly omitted. Additional manufacturing steps are also advantageously omitted in that, within one casting cell, the cast raw casting can, after the cooling process, be deburred and advantageously simultaneously also straightened, wherein the coarse deburring and the fine deburring are advantageously performed during one processing step. In the context of the invention, deburring is to be understood to mean mechanical processing of the raw casting, in the case of which the casting and overflow system are removed. The casting machine, which can also be referred to as a die casting machine, advantageously has a mold closure unit which serves for the opening and closing of the die casting mold and in particular of the cavity. The mold closure unit itself advantageously has a fixed machine plate for receiving a static casting-in mold half and a movable machine plate for receiving a hydraulic ejector. The movable machine plate is advantageously guided by way of guide columns. The fixed machine plate and the movable machine plate are closed for example by way of a closing cylinder. The liquid material, that is to say the melt, for the production of the raw casting is forced for example out of a casting chamber with a casting piston into the mold or cavity, wherein, depending on the type of machine used, a distinction can be made in particular between a hot-chamber process and a cold-chamber process.

All of the advantages that have already been described with regard to a processing apparatus according to the invention as per a first aspect of the invention arise in the case of the casting cell according to the invention.

Also provided is a method for the production of a cast component, having at least the steps:

casting a raw casting by way of a casting machine within at least one cavity of the casting machine, measuring the temperature of at least one section of the cast raw casting by way of a temperature measurement device, and processing the cast raw casting by way of a flowable medium applied to the raw casting by a processing apparatus.

The cast component itself is advantageously a processed raw casting, wherein the raw casting is cast or produced within a cavity of the casting machine, and can be transferred, for processing purposes, to a processing apparatus. Grippers or transportation devices advantageously serve for transferring the raw casting from the cavity of the casting machine to the processing apparatus, wherein the casting machine and the processing apparatus are advantageously units or apparatuses of a common casting cell. After the processing of the raw casting, the cast component is realized, which can consequently be integrated, as a finished component, into a component assembly. To determine those sections in which the raw casting should be processed by way of the flowable medium, use is made of a temperature measurement device for the measurement of the temperature, wherein the temperature measurement device may in particular be a temperature measurement system, such as for example a temperature gauge or a temperature sensor etc., or possibly also a thermal imaging camera. The temperature measurement device advantageously determines the temperature of the cast raw casting in real time and transmits the determined temperature measurement values for example to a comparison device for the comparison of the determined measurement values with corresponding reference values stored in a memory device. The processing of the raw casting is controlled or regulated on the basis of the comparison values. This means that, if the raw casting is cooled for example to a temperature of below 50° C., an application of the flowable medium at least in defined sections of the raw casting is ended.

It is advantageously possible with the method according to the invention for the raw casting to be at least cooled or straightened by way of the flowable medium. It is consequently advantageously the case that, during the cooling process, a first processing step for the processing of the raw casting on the path to realizing the cast component, that is to say the straightening of the raw casting, is also made possible at the same time. In the context of the invention, the expression "straightening" is to be understood to mean targeted temporally and spatially variable cooling of the raw casting. In particular taking into consideration the fact that both the casting process itself and the subsequent cooling phase can be understood as causes for distortion of a casting, it is possible in particular, by way of the application of the flowable medium, to generate stresses by way of an inhomogeneous temperature distribution resulting from targeted temporally and spatially variable cooling of individual sections or positions of the raw casting. Accordingly, the occurring distortion can thus be counteracted in targeted fashion by way of the cooling, or targeted straightening can be effected. Accordingly, the need for a straightening process after the cooling process is advantageously omitted. In the context of the invention, it is advantageously possible for the configuration of the cooling process and of the straightening process to be performed in particular in simulation-based fashion.

It is furthermore contemplated for the flowable medium to be applied in the form of a spray mist to the raw casting, wherein the application of the medium is temporally, spatially and/or quantitatively controlled by way of a control device. Accordingly, the nozzle device can be controlled by way of the control device, wherein the nozzle device itself may be arranged rigidly with respect to the raw casting to be cooled, or else movably relative thereto. If, in particular, the nozzle device, wherein a plurality of nozzle devices may also be arranged within the spraying apparatus, is or are arranged in static or immovable fashion in the spraying apparatus, it is advantageously the case that the raw casting itself is moved in the direction of a transport path along the at least one nozzle device or past the nozzle device and is advantageously rotated about its longitudinal axis, such that it is made possible for any section of the raw casting to be wetted by way of the flowable medium atomized by the nozzle device.

It is furthermore contemplated for the nozzle device itself to also be arranged so as to be movable relative to the raw casting, wherein the nozzle device is advantageously arranged within the spraying apparatus so as to be movable in three translational degrees of freedom and in three rotational degrees of freedom with respect to or relative to the raw casting to be cooled.

It is furthermore contemplated for not only the nozzle device itself but also the raw casting to be cooled to be arranged movably within the spraying apparatus, such that consequently, the raw casting and also the nozzle device, can be moved relative to one another. It is advantageously the case, if a plurality of nozzle devices is provided within the spraying apparatus, that each nozzle device is actuated separately by way of, for example, the control device, such that it is contemplated for each nozzle device to apply mutually different amounts of flowable medium in different time intervals and different mixture ratios to separate sections or regions of the raw casting to be cooled. The throughflow rate of the flowable medium per nozzle or per nozzle device is advantageously monitored and adjusted in real time, wherein this is performed in particular by the control device. The control device itself is advantageously a unit of the processing apparatus and connected to the nozzle device in wired or wireless fashion for data communication purposes. It is furthermore contemplated that, if a plurality of nozzle devices is provided, some of the nozzle devices are arranged so as to be static or immovable, whereas others of the nozzle devices are arranged dynamically or movably within the spraying apparatus. It is accordingly contemplated for the spraying apparatus to have a dynamic nozzle field or a static nozzle field, or even a dynamic nozzle field in addition to a static nozzle field.

It is furthermore possible for a geometry measurement device to measure at least one geometry of the cast raw casting. The geometry of the cast raw casting is for example a length, a width, an angle or a similar dimension, wherein the geometry measurement device is advantageously a unit of the processing device or an independent unit or device which is connected to the processing device in wireless or wired fashion for data communication purposes. The geometry measurement device is advantageously an optical distance measuring device. The geometry measurement device is advantageously connected at least to a comparison device and/or a control device in wireless or wired fashion for data communication purposes, in order to transmit the determined or measured geometry values, and in particular geometry actual values, to the comparison device and/or to the control device.

In the context of the invention, a comparison device compares the temperature value measured by the temperature measurement device with a reference temperature value, and/or compares the geometry value measured by the geometry measurement device with a reference geometry value. The comparison device itself may, for example, in this case be a unit or a device of the processing apparatus, or else may be a separate or independent device which is merely connected to the processing apparatus in wired or wireless fashion for data communication purposes. The comparison device is advantageously connected to the control device in particular for data communication purposes. The reference values, such as in particular the reference geometry values and/or the reference temperature values, are for example stored in a memory device of the comparison device, wherein the memory device may also be an independent device in relation to the comparison device, which is merely connected to the comparison device in wired or wireless fashion for data communication purposes. The comparison device itself serves for setpoint-actual value interrogation or setpoint-actual value comparison, wherein the values determined by the temperature measurement device or by the geometry measurement device are compared with the stored reference values. The comparison device advantageously also serves as an evaluation device, and determines, on the basis of the comparison between the setpoint values and the actual values, whether or not processing of the raw casting in defined sections of the raw casting is necessary. This means that, on the basis of the determined values, that is to say the temperature and/or geometry values, a determination is performed as regards what section of the raw casting must have a flowable medium applied thereto, in what mixing ratio and over what time duration, in order in particular to achieve adequate cooling of the raw casting for the subsequent deburring and also straightening of the raw casting.

Accordingly, it is likewise contemplated that, after a determination of at least one geometry value and/or in particular of at least one temperature value of the raw casting, the at least one determined item of data is compared with values, which are advantageously stored in a memory device, for example in a database, relating to the geometry and/or the temperature, whereupon a corresponding stored processing program, and in particular spraying program, can be initiated or activated. This means that it is possible for different spraying programs to be stored so as to be associated with different data relating to the temperature and/or geometry of different cast components to be produced, which different spraying programs can be executed in a manner taking into consideration the determined values or data. Thus, it is advantageously the case that continuous measurement or determination of individual values, such as the temperature and/or the geometry of the raw casting, is avoided. The spraying program or spraying strategy regulates, for example, which nozzle device must be actuated, which nozzle device must apply what amount of medium, in what mixing ratio, to the raw casting, and/or how the nozzle devices should be moved relative to the raw casting and/or the raw casting should be moved relative to the nozzle devices.

In the context of the invention, it is furthermore contemplated for the raw casting to be subjected to coarse deburring and fine deburring during one processing step. This means that it is advantageously the case that the entire deburring process takes place after the cooling process in one working step and advantageously within the processing apparatus. An additional fine deburring process after a coarse deburring process by way of an additional apparatus is advantageously avoided according to the present invention, such that the processing of the raw casting to form a cast component can be performed inexpensively and in a reduced time.

It is furthermore contemplated for the cast component to be produced within one casting cell. Consequently, it is advantageously possible for the cast component to be produced within one casting cell of the abovementioned type, such that transportation of the raw casting out of the casting cell for the deburring process, in particular for the fine deburring process, and/or for additional straightening of the raw casting is advantageously omitted, whereby transportation paths and transportation costs can advantageously be saved.

As a processing apparatus for the processing of the raw casting, use is advantageously made of a processing apparatus of the abovementioned type.

All of the advantages that have already been described with regard to a processing apparatus and/or a casting cell according to the first aspects of the invention arise in the case of the method described.

An embodiment of a processing apparatus according to the invention, and the sequence or the method for the processing of the raw casting, will be discussed in more detail below.

Other objects, advantages and novel features of the present invention will become apparent from the following detailed description of one or more preferred embodiments when considered in conjunction with the accompanying drawings.

Figure 1:
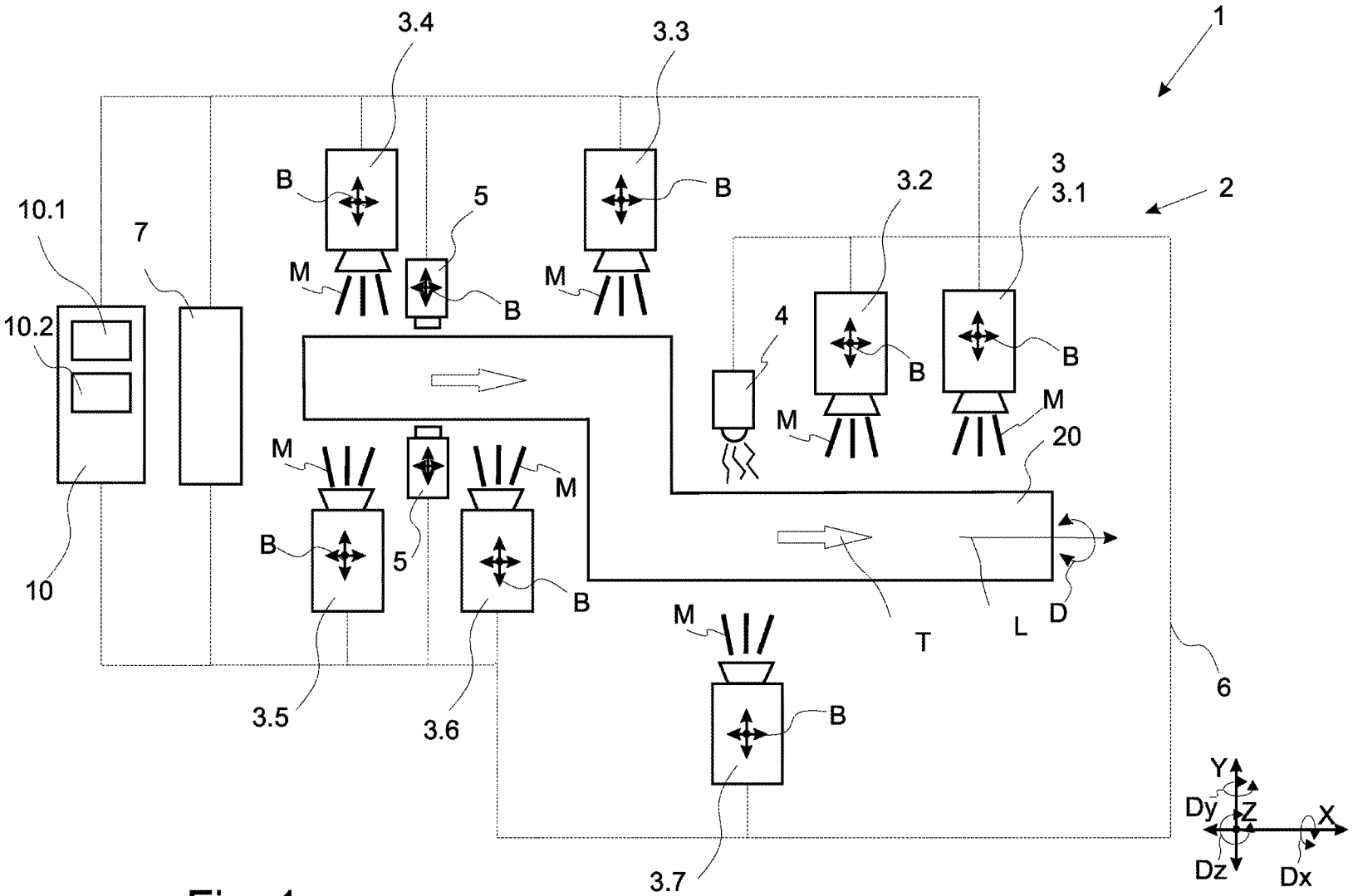
FIG. 1 shows a functional sketch of an embodiment of a processing apparatus according to the invention.
Figure 2:
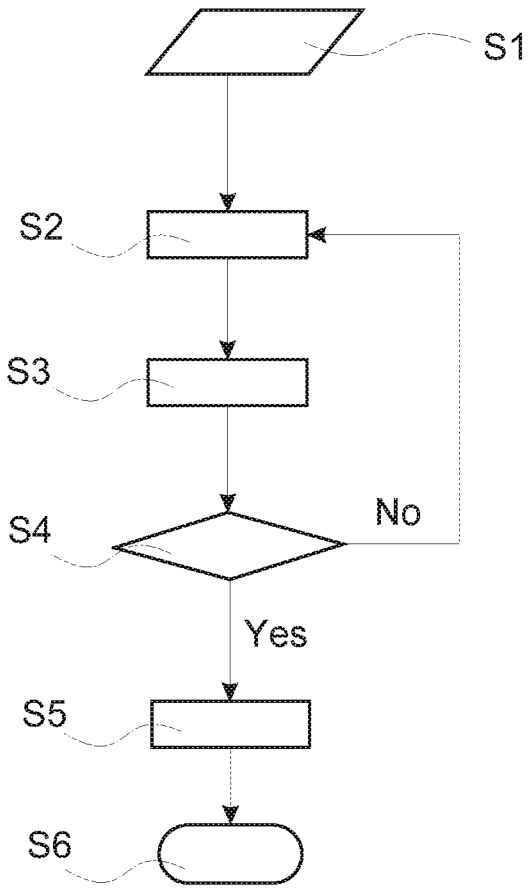
FIG. 2 shows a flow diagram relating to an embodiment of the method for the processing of the raw casting.
Figure 3:
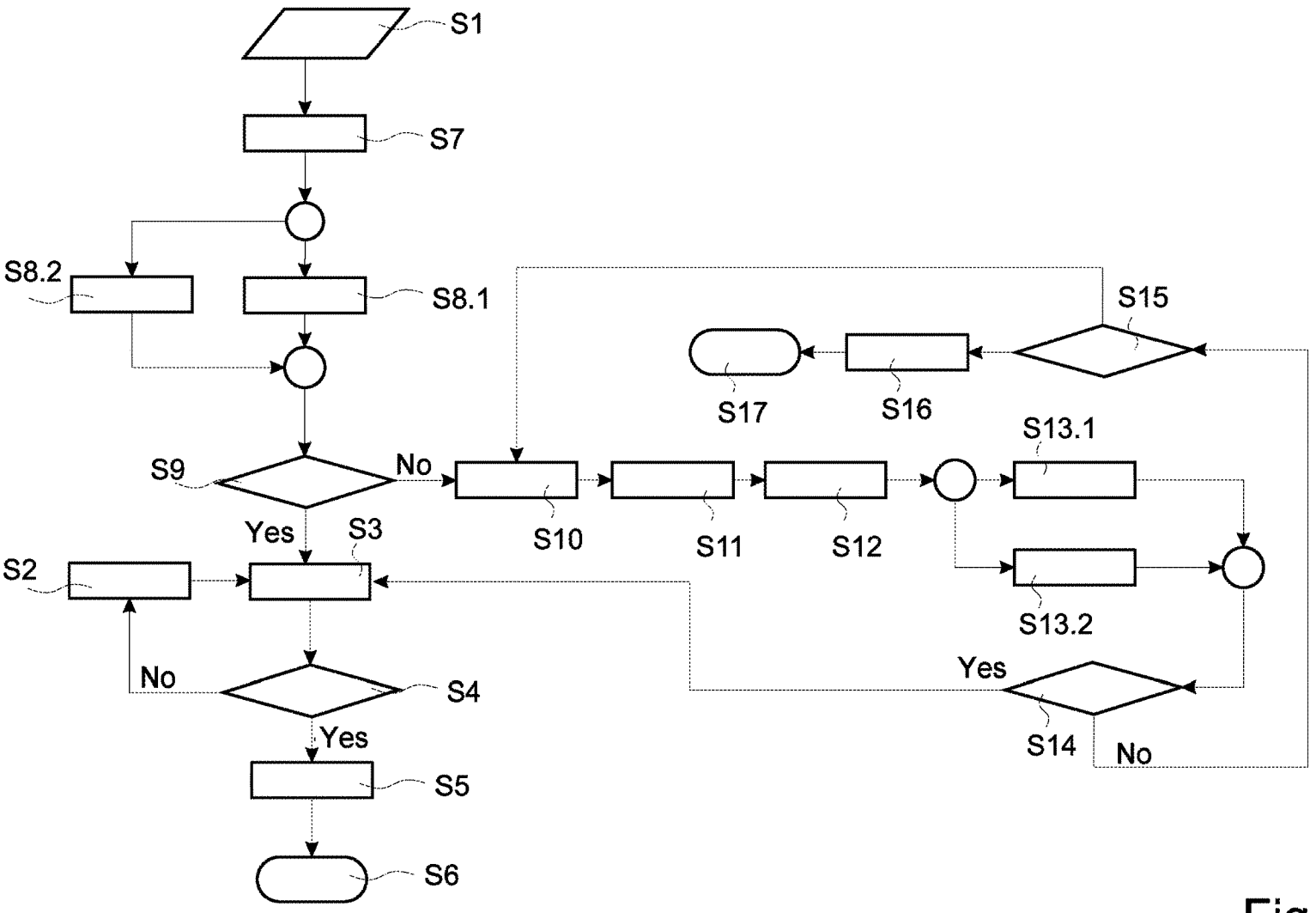
FIG. 3 shows a flow diagram relating to a further embodiment of the method for the processing of the raw casting.

Elements of identical function and mode of operation are denoted in each case by the same reference designations in FIGS. 1 to 3.

DETAILED DESCRIPTION OF THE DRAWINGS

FIG. 1 schematically shows a functional sketch of an embodiment of a processing apparatus 1 for the processing of a raw casting 20. The processing apparatus 1 has a spraying apparatus 2 having a nozzle device 3 and, in particular, a plurality of nozzle devices 3.1 to 3.7. The nozzle devices 3 or 3.1 to 3.7 are arranged along a transport path T within the processing apparatus 1 in order to apply a flowable medium M to at least sections or regions of the raw casting 20. The individual nozzle devices 3, 3.1 to 3.7 are advantageously arranged so as to be movable in a movement direction B, and in particular in an X, Y and/or Z direction, or in the direction of X, Y, Z axes, relative to the raw casting 20 to be cooled. Furthermore, it is possible for the nozzle devices 3, 3.1 to 3.7 to be movable rotatably about the X, Y and/or Z axes, and consequently in Dx, Dy and/or Dz rotation directions. It is, however, also contemplated for the individual nozzle devices 3, 3.1 to 3.7 to be arranged in static fashion within the processing apparatus, such that only the raw casting 20 moves along the transport path T.

The raw casting 20 advantageously has a longitudinal axis L about which the raw casting 20 can rotate in the rotation direction D, such that it can be made possible for the flowable medium M to be applied to any section of the raw casting 20. It is furthermore contemplated for the nozzle devices 3, 3.1 to 3.7 to be arranged so as to be rotationally movable about the raw casting 20, or to be able to be moved such that, consequently, the nozzle device 3 or the nozzle devices 3.1 to 3.7 can rotate about the longitudinal axis L of the raw casting 20. The nozzle devices 3, 3.1 to 3.7 advantageously have at least three degrees of freedom in translational directions, and consequently in the X, Y and Z directions, and three degrees of freedom in rotation directions, and advantageously consequently in the Dx, Dy and Dz rotation directions.

The processing apparatus 1 furthermore has a temperature measurement device 4 and a geometry measurement device 5, which are arranged along the transport path T in order to be able to measure or determine a temperature and, in particular, a surface temperature and a geometry, such as a length dimension or a width dimension or else an angle dimension, of the raw casting 20. The temperature measurement device 4 and/or the geometry measurement device 5 are advantageously arranged so as to be movable relative to the raw casting 20 in order to be able to cover any section of the raw casting 20 in order to consequently be able to determine the temperature and/or the dimensions of the raw casting 20 in any section. With regard to the possible degrees of freedom of movement of the temperature measurement device 4 and/or of the geometry measurement device 5, reference is made to the abovementioned degrees of freedom of the movement of the nozzle devices 3, 3.1 to 3.7, wherein, in the present case, it is assumed that the temperature measurement device 4 and/or the geometry measurement device 5 can also perform corresponding movements. This means that, as also already mentioned with regard to the nozzle devices 3, 3.1 to 3.7, it is contemplated for the temperature measurement device 4 and/or the geometry measurement device 5 to also be able to be arranged so as to be static, and consequently immovable relative to the raw casting 20, wherein it is however necessary in this case for at least the raw casting 20 to be moved in the translational direction T and/or in the rotation direction D, that is to say in the rotation direction D about its longitudinal axis L. Furthermore, it is contemplated for the geometry measurement device 5 and/or the temperature measurement device 4 to be composed of a plurality of measurement devices which are arranged spaced apart from one another in the processing apparatus 1.

The individual nozzle devices 3, 3.1 to 3.7 and the temperature measurement device 4 and the geometry measurement device 5 are advantageously connected to a comparison device 10 via data communication lines 6. Here, it is also contemplated for the data transmission between the nozzle device 3, 3.1 to 3.7, the temperature measurement device 4 and/or the geometry measurement device 5 and the comparison device 10 to take place in wireless fashion, for example via Bluetooth or WLAN etc. The comparison device 10 advantageously serves for comparing the actual values relating to the temperatures, in particular the surface temperature, and/or to the individual dimensions or geometry values of the raw casting 20, as received from the temperature measurement device 4 and/or from the geometry measurement device 5, with in particular reference values that are advantageously stored in a memory device 10.1 of the comparison device 10. The comparison device 10 advantageously also has an evaluation device 10.2 which serves for determining which section of the raw casting 20 must still have flowable medium M applied thereto, and/or what mixing ratio the flowable medium M must have, and/or in what timeframe the respective section of the raw casting 20 must be wetted with the flowable medium M, in order in particular to realize continuous and uniform cooling of the raw casting 20 and advantageously prevent distortion of the component during the cooling process.

Furthermore, in FIG. 1, the reference designation 7 denotes a control device which advantageously serves to control the individual nozzle devices 3, 3.1-3.7 of the spraying apparatus 2 in accordance with demand. It is thus contemplated that, after the determination of the temperature or of at least one temperature value of the raw casting 20, and/or after the determination of a geometry or at least one geometry value of the raw casting 20, the control device 7 is triggered so as, for example, to activate or deactivate at least some of the nozzle devices 3, 3.1-3.7, to control and/or regulate the spraying duration thereof, and/or to control and/or regulate the mixture ratio of the flowable medium, etc.

FIG. 2 shows a flow diagram of a method for the processing of a raw casting. In a step S1, the raw casting, proceeding from the casting machine, is provided to the processing apparatus. In a subsequent step S2, the raw casting, and in particular at least one section of the raw casting, is impinged on with a flow of the flowable medium, which is in particular a water-air mixture, and is in particular wetted by way of the nozzle device. In a subsequent step S3, it is advantageously the case that, by way of the temperature measurement device, the temperature and, in particular, a surface temperature of at least one section of the raw casting is measured or detected and supplied to a comparison device which, in a step S4, compares the determined temperature measurement value, which may also be referred to as a temperature actual value, with a reference temperature value, and in particular with a threshold value, which is advantageously stored in a memory device of the comparison device, and which may also be referred to as temperature setpoint value. If the measured temperature actual value has a greater value than the reference temperature value, the method is continued with the step S2, and the corresponding section continues to be wetted with the flowable medium until the measured temperature actual value reaches the reference temperature value or threshold value, which is advantageously 50° C. or lower. Consequently, if the measured temperature actual value reaches the threshold value, the comparison device knows that at least the measured section of the raw casting has cooled to an adequate extent, such that the raw casting can be subjected to fine deburring. For this purpose, it is possible, in a further step S5, for the raw casting, and in particular the cooled raw casting, to be removed from the spraying apparatus and supplied to a deburring area. Consequently, in a final step S6, the deburring is performed, which is in particular a combination of a coarse deburring process and a fine deburring process. After the deburring of the raw casting, a cast component has been provided, which can consequently be arranged in a component assembly in order to produce a final product. It is furthermore contemplated for the step S5, and in particular the removal of the cooled raw casting from the spraying apparatus, to be omitted, in particular if the deburring itself, and in particular the fine deburring and/or coarse deburring, takes place, as illustrated in step S6, within the spraying apparatus, which is in particular a constituent part of the processing apparatus.

FIG. 3 shows a flow diagram of a further embodiment of a method for the processing of a raw casting, wherein, in addition to the mere cooling of the raw casting, and in particular of a section of the raw casting, a straightening of the raw casting is also shown. The raw casting, after being produced in a cavity and, in particular, in a casting machine, is advantageously provided to the processing apparatus in the step S1. In the subsequent step S7, the raw casting is advantageously measured by way of a geometry measurement device, such that, for example, the length and/or width thereof, and/or the angle thereof and in particular the overall geometry thereof, can be measured. It is furthermore contemplated that, at least at times during the measurement of the raw casting or during the determination of at least one geometry value of the raw casting, the raw casting is rotated or moved within the measurement device in order to make it possible for individual regions or sections of the raw casting to be measured. It is, however, also contemplated for only the measurement devices or the at least one measurement device to be able to be moved along at least one section of the raw casting for the determination of the at least one geometry value. Accordingly, it is likewise possible for both the raw casting and the at least one measurement device to be able to be moved relative to one another.

During the evaluation of the measurement data relating to the geometry of the raw casting by way of a comparison device, as shown in particular in step S8.1 in FIG. 3, it is advantageously possible, in parallel with or at the same time as the evaluation process or the process of the setpoint-actual value comparison, for the raw casting to be transported or transferred for example into a spraying apparatus, as shown in particular by step S8.2. Consequently, it is contemplated for the apparatus for the measurement of the geometry and the spraying apparatus to be apparatuses that are separate from one another, and between which the raw casting can be transferred for processing purposes. It is, however, also contemplated for the measurement apparatus and the spraying apparatus to constitute a common apparatus for the processing of the raw casting, such that the step S8.2 would consequently be omitted. The comparison device firstly evaluates the determined geometry values with regard to reference values that are advantageously stored in a memory device of the comparison device, and secondly checks, in a subsequent step S9, whether any determined geometry deviations lie within predefined tolerance ranges. If the determined or measured dimensions or geometries correspond to the predefined reference values, or if they lie within admissible tolerance thresholds, then in a subsequent step S3, the temperature and, in particular, the surface temperature of the raw casting is advantageously determined by way of a temperature measurement device. The determined temperature measurement values, which can also be referred to as temperature actual values, are in turn transmitted to the comparison device, which compares the received or measured temperature actual values with a corresponding reference value or temperature threshold value, and in particular a temperature setpoint value, in a step S4, wherein the one or more temperature threshold values is/are in turn advantageously stored in a memory device of the comparison device. If the measured temperature actual value is greater than a predefined temperature threshold value, at least a section, and advantageously individual sections, of the raw casting are acted on with the flowable medium, as shown in particular in step S2. It is advantageously the case that the temperature measurement by way of the temperature measurement device is in turn performed during or even after the action of the flowable medium on the raw casting, in order to make it possible to determine whether the temperature of the raw casting has reached the predefined temperature threshold value. Accordingly, it is advantageously the case that, during the action of the flowable medium on the raw casting, a continuous temperature measurement is performed, as illustrated by step S3, and a comparison of the determined temperature values with the stored temperature threshold value is performed, as shown in step S4, such that the attainment of the temperature threshold value can be determined in real time. If the comparison device determines that the temperature actual value has reached the temperature threshold value or lies below the temperature threshold value, the raw casting, and in particular the cooled raw casting, is advantageously removed from the spraying apparatus, as shown in step S5, and supplied for a deburring process for the coarse and fine deburring, wherein the deburring process itself may also be performed within the spraying apparatus.

If the geometry measurement device determines a geometry or measurement deviation in the preceding step S8.1, wherein the determined measurement deviation furthermore does not lie within predefined tolerance thresholds, as shown in step S9, then a targeted action of the flowable medium on individual sections of the raw casting, as shown in step S10, is initiated. After the cooling or the spray cooling of the raw casting, the raw casting can again, as shown, for example, in step S11, be removed from the spraying apparatus and supplied to a measurement apparatus for the measurement of the geometry and determination of at least one geometry value of the raw casting. Consequently, step S11 would describe transportation of the raw casting. It is however also contemplated that, as already mentioned above, the measurement apparatus and the spraying apparatus form a common apparatus, such that transportation of the raw casting between the individual steps of measurement and cooling is not necessary. In this case, step S11 could be understood as handling of the raw casting after or at least also at times during the targeted action of the flowable medium on the individual sections of the raw casting, in such a way that said raw casting can for example be moved within the combined measurement and spraying apparatus and in particular rotated about a certain axis of rotation or longitudinal axis in different directions. In this case, step S11, and step S12 discussed below, would advantageously coincide.

In step S12 in FIG. 3, it is for example the case that a geometry measurement by way of the geometry measurement device is in turn performed during and advantageously after the targeted impingement of the flowable medium on the raw casting, in order, in turn, to obtain geometry actual values, which are transmitted to the comparison device. This in turn performs, in a step S13.1, a setpoint-actual value comparison of the determined geometry values. During the evaluation of the data or measurement values, it is contemplated for the raw casting to be removed again from the measurement apparatus and transferred to a spraying apparatus, as shown in particular by step S13.2, which advantageously takes place at the same time as or in parallel with the step S13.1. However, if the measurement apparatus and the spraying apparatus are a common apparatus, then step S13.2 constitutes, in particular, handling of the casting, in the case of which, during the measurement and/or the evaluation of the measurement data, spray cooling and/or continuous measurement of the raw casting, and a determination of the geometry data thereof, are performed. If the determined geometry actual values correspond to the geometry setpoint values that are advantageously stored in a memory device, or if the determined geometry actual values lie within predefined tolerance thresholds, then the step S14 is followed by the step S3, as already described above, and consequently the temperature measurement by way of the temperature measurement device. Otherwise, in a step S15, it is determined whether at least one of possible rejection criteria is met. Rejection criteria are, for example, intense deformations, or regions or sections of the raw casting that have already cooled to too great an extent, such that the raw casting can no longer be straightened or processed by way of the flowable medium in order to produce a corresponding cast component. Consequently, the raw casting that can no longer be processed is rejected from the processing apparatus in a step S16 and supplied to a reject container, as shown by step S17. If the raw casting does not meet the rejection criteria, it continues to be acted on with the flowable medium in defined sections or regions, such that straightening of the component, as initiated by step S10, is continued.

It is advantageously the case that, with the processing apparatus according to the invention and the method according to the invention for the processing and for the production of a cast component, a deburring step, and consequently a press and a punching tool, are omitted, because in particular, the coarse deburring and the fine deburring can be performed in one processing step after the cooling of the raw casting. Furthermore, it is advantageously the case that subsequent manual straightening of the parts is no longer necessary, in particular because straightening of the components can be performed by way of the flowable medium, which is also used for cooling purposes. Consequently, the transportation and storage costs are thus advantageously reduced.

LIST OF REFERENCE DESIGNATIONS

1 Processing apparatus
2 Spraying apparatus
3, 3.1-3.7 Nozzle device
4 Temperature measurement device
5 Geometry measurement device
6 Data communication line
7 Control device
10 Comparison device
10.1 Memory device
10.2 Evaluation device
20 Raw casting
B Movement direction
D Rotation direction
Dx Rotation direction about X axis
Dy Rotation direction about Y axis
Dz Rotation direction about Z axis
L Longitudinal axis
M Flowable medium
S1 Provision of the raw casting
S2 Action of the flowable medium on the raw casting
S3 Measurement of the temperature
S4 Comparison of the temperature actual value with the temperature threshold value
S5 Removal of the cooled raw casting
S6 Deburring
S7 Geometry measurement
S8.1 Setpoint-actual value comparison
S8.2 Handling of the raw casting
S9 Comparison of the dimensional deviation with a predefined tolerance
S10 Targeted action of the flowable medium on the raw casting
S11 Handling of the raw casting
S12 Geometry measurement
S13.1 Setpoint-actual value comparison
S13.2 Handling of the raw casting
S14 Comparison of the determined dimensional deviation with respect to a predefined tolerance
S15 Determination of whether at least one rejection criterion is met
S16 Rejection of the casting
S17 Rejects
T Transport path
X X axis
Y Y axis
Z axis The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A processing apparatus for processing a cast raw casting, the processing apparatus comprising:

a spraying apparatus for cooling the raw casting, said spraying apparatus having at least one nozzle device for temporally, spatially, or quantitatively variable application of a flowable medium to at least one section of the raw casting;

a temperature measurement device for measurement of temperature at at least one section of the raw casting; and a control device operatively configured to control and regulate the at least one nozzle device as a function of measured temperature;

wherein the processing apparatus is configured to coarsely deburr and finely deburr the raw casting during a single processing step.

2. The processing apparatus according to claim 1, further comprising:

a geometry measurement device for measurement of at least one geometry of the raw casting.

3. The processing apparatus according to claim 2, further comprising:

a comparison device that: (i) compares a value of the measured temperature with a reference temperature value, and/or (ii) compares a value of the measured geometry with a reference geometry value.

4. The processing apparatus according to claim 1, wherein the at least one nozzle device has at least one two-substance nozzle for application of two mutually different flowable substances to the raw casting, and by way of the two-substance nozzle, the two mutually different flowable substances are combinable in a quantitatively variable fashion to form the flowable medium.

5. The processing apparatus according to claim 1, wherein the spraying apparatus has a plurality of nozzle devices arranged statically or movably relative to the raw casting to be cooled, the plurality of nozzle devices being arranged spaced apart from one another within the spraying apparatus.

6. A casting cell for producing a cast component, the casting cell comprising:

a casting machine having at least, one cavity for generating a raw casting; and a processing apparatus for processing the raw casting, the processing apparatus comprising:

a spraying apparatus for cooling the raw casting, said spraying apparatus having at least one nozzle device for temporally, spatially, or quantitatively variable application of a flowable medium to at least one section of the raw casting;

a temperature measurement device for measurement of temperature at at least one section of the raw casting; and a control device operatively configured to control and regulate the at least one nozzle device as a function of measured temperature;

wherein the casting cell is configured to coarsely deburr and finely deburr the raw casting during a single processing step.

7. The casting cell according to claim 6, wherein the processing apparatus further comprises:

a geometry measurement device for measurement of at least one geometry of the raw casting.

8. The casting cell according to claim 6, wherein the processing apparatus further comprises:

a comparison device that: (i) compares a value of the measured temperature with a reference temperature value, and/or (ii) compares a value of the measured geometry with a reference geometry value.

9. The casting cell according to claim 6, wherein the at least one nozzle device has at least one two-substance nozzle for application of two mutually different flowable substances to the raw casting, and by way of the two-substance nozzle, the two mutually different flowable substances are combinable in a quantitatively variable fashion to form the flowable medium.

10. The casting cell according to claim 6, wherein the spraying apparatus has a plurality of nozzle devices arranged statically or movably relative to the raw casting to be cooled, the plurality of nozzle devices being arranged spaced apart from one another within the spraying apparatus.

11. A method for producing a cast component, the method comprising the acts of:

casting a raw casting, via a casting machine, within at least, one cavity of the casting machine;

measuring a temperature of at least one section of the cast raw casting via a temperature measurement device; and processing the cast raw casting by way of a flowable medium applied to the cast raw casting by a processing apparatus;

wherein the raw casting is subjected to coarse deburring and fine deburring during a single processing step.

12. The method according to claim 11, wherein the raw casting is at least cooled or straightened via the flowable medium.

13. The method according to claim 12, wherein:

the flowable medium is applied in a spray mist form to the raw casting, and application of the flowable medium is temporally, spatially, and/or quantitatively controlled via a control device.

14. The method according to claim 11, wherein at least one geometry of the raw casting is measured via a geometry measurement device.

15. The method according to claim 14, wherein:

a value of the temperature measured by the temperature measurement device is compared, via a comparison device, with a reference temperature value, and/or a value of the at least one geometry measured by the geometry measurement device is compared with a reference geometry value.

16. The method according to claim 11, wherein the cast component is produced within one casting cell having:

a casting machine having at least one cavity for generating a raw casting; and a processing apparatus for processing the raw casting, the processing apparatus comprising:

a spraying apparatus for cooling the raw casting, said spraying apparatus having at least one nozzle device for temporally, spatially, or quantitatively variable application of a flowable medium to at least one section of the raw casting;

a temperature measurement device for measurement of temperature at at least one section of the raw casting; and a control device operatively configured to control and regulate the at least one nozzle device as a function of measured temperature.

17. The method according to claim 11, wherein the act of processing the cast raw casting makes use of the processing apparatus comprising:

a spraying apparatus for cooling the raw casting, said spraying apparatus having at least one nozzle device for temporally, spatially, or quantitatively variable application of a flowable medium to at least one section of the raw casting;

a temperature measurement device for measurement of temperature at at least; one section of the raw casting; and a control device operatively configured to control and regulate the at least one nozzle device as a function of measured temperature.

* * * * *